US005082272A

United States Patent [19]

Xydias et al.

[11] Patent Number: 5,082,272

[45] Date of Patent: Jan. 21, 1992

[54] HIGH-SPEED SHEET INVERTER AND METHOD FOR INVERTING SHEETS

[75] Inventors: Jean Xydias, Pittsford; Gerald M. Hitchcock, Rochester; Robert D. LeRoy, Rochester; James M. Montgomery, Bergen; Curtis L. Vernon, Rochester, both of N.Y.

[73] Assignee: Eastman Kodak Company, Rochester, N.Y.

[21] Appl. No.: 620,129

[22] Filed: Nov. 30, 1990

[51] Int. Cl.[5] ..... B65H 29/00

[52] U.S. Cl. ..... 271/186; 271/65; 271/902

[58] Field of Search ..... 271/65, 186, 188, 902

[56] References Cited

U.S. PATENT DOCUMENTS

| | | | |
|---|---|---|---|
| 4,214,740 | 7/1980 | Acquaviva | 271/3 |
| 4,262,895 | 4/1981 | Wenthe, Jr. | 271/65 |
| 4,531,725 | 7/1985 | Seelen | 271/186 |
| 4,673,176 | 6/1987 | Schenk | 271/186 |
| 4,699,367 | 10/1987 | Russel | 271/186 X |
| 4,842,262 | 6/1989 | Carrish | 271/186 |
| 4,842,263 | 6/1989 | Robertson | 271/186 |

FOREIGN PATENT DOCUMENTS

| | | | |
|---|---|---|---|
| 75392 | 5/1982 | Japan | 271/186 |
| 15346 | 1/1985 | Japan | 271/65 |
| 162457 | 7/1986 | Japan | 271/186 |
| 264156 | 11/1987 | Japan | 271/186 |
| 150669 | 6/1989 | Japan | 271/186 |
| 299155 | 12/1989 | Japan | 271/186 |

*Primary Examiner*—D. Glenn Dayoan
*Assistant Examiner*—Boris Milef
*Attorney, Agent, or Firm*—Tallam I. Nguti

[57] ABSTRACT

A high-speed sheet inverter mechanism includes a sheet confinement chamber suitable for confining a first sheet and a second sheet at the same time, and three roll assemblies for feeding sheets into, and discharging sheets from, the chamber. The sheet inverter device further includes a simultaneous sheet handling approach angle of about 48° at which a sheet entering the mechanism contacts a sheet exiting the mechanism.

13 Claims, 4 Drawing Sheets

HIGH-SPEED SHEET INVERTER AND METHOD FOR INVERTING SHEETS

BACKGROUND OF THE INVENTION

1. Technical Field

This invention relates to sheet inverters for use with a sheet handling equipment, and more particularly, to a highly efficient and reliable high-speed sheet inverter mechanism and method for inverting sheets particularly suited for use in a high-speed copier or printer.

2. Background Art

As disclosed, for example, in U.S. Pat. Nos. 4,673,176 and 4,842,262, sheet inverter mechanisms are well known for use in electrostatographic copiers and printers. Such inverter mechanisms are used to reverse the lead and trail edge, and hence the front-and-back face, orientations of a sheet being used for imaging thereon in the copier or printer.

Typically, sheet inverter mechanisms include a three-roll assembly and a curved narrow sheet turnover or confinement chamber with sheet recoil means therein. The roll assembly forms sheet entrance and exit nips to the chamber. A sheet is fed into the chamber through the entrance nip, lead edge first, and its trail edge is then "walked" by the roller assembly from the entrance nip to the exit nip. The roller assembly thereafter then feeds the sheet through the exit nip out of the chamber, trail edge first, thereby reversing the lead and trail edge orientations of the sheet.

Many things can and do go wrong with a sheet being inverted as such. As a consequence, the art of sheet inverters has become highly developed. Things go wrong because different size sheets, for example, may be used, or because the dimensions of a particular size sheet may vary from sheet-to-sheet, and so also may the exact positioning of the roller assembly and the recoil means. The undesirable results, for example, may include trail edge jams and misfeeds. Finger and paddle assemblies, as disclosed for example in U.S. Pat. Nos. 4,842,262 and 4,842,263 have been proposed for overcoming such resulting trail edge jams and misfeeds.

Additionally, the weight and beam strength of sheets may vary, thus, for example, introducing variable and premature buckling of sheets within the turnover or confinement chamber. For overcoming such problems, corrugation roller assemblies and buckle-spring assemblies, for examples, have been proposed in U.S. Pat. Nos. 4,673,176 and 4,262,895. Finally, other prevalent problems occur, for example, sheet skewing, lack of precise sheet control, and sheet interference within the turnover or confinement chamber, especially in turnover mechanisms used with high-speed equipment. To reduce these problems, special chamber geometry, and sheet-entrance and sheet-exit sensors for examples have been proposed in U.S. Pat. Nos. 4,531,725 and 4,214,740.

The above problems, for examples, are particularly serious in high-speed equipment such as copiers or printers which run at 100 sheets or more per minute. In order for the inverter to keep up with such a copier or printer, it has been suggested, for example, in the aforesaid 4,673,176 patent, to run consecutive sheets simultaneously through the turnover or confinement chamber thereby increasing the sheet throughput rate of the inverter. Alternatively, the inverter can be speeded up so as to continue to invert sheets singly through the chamber. Speeding up the inverter, however, has been found to introduce additional and unacceptable reliability problems.

On the other hand, simultaneous sheet handling at high speeds has been found to involve serious interference problems between the entering sheet and the exiting sheet. For example, the trailing edge of the exiting sheet may be caught and trapped in the chamber by an entering sheet, or the lead edge of an entering sheet may be caught and directly diverted into the exit nip by the exiting sheet. At such high speeds, the trail edge of the entering sheet may fail for various reasons to reliably and efficiently go from the entrance nip to the exit nip. For example, variations in sheet size and weight may make the "walking over" approach to trail edge transfer from the entrance nip to the exit nip, inefficient and unreliable.

SUMMARY OF THE INVENTION

It is, therefore, an object of the present invention to provide a highly efficient and reliable sheet inverter mechanism for use in high-speed sheet handling equipment.

It is also an object of the present invention to provide a high-speed sheet inverter mechanism that is capable of handling sheets of various beam strengths and weights.

It is a further object of the present invention to provide such a sheet inverter mechanism that can efficiently and reliably handle simultaneously, a sheet entering its confinement chamber and a sheet exiting therefrom.

In accordance with the present invention, a high-speed sheet inverter mechanism is provided for use in sheet-handling equipment. The inverter mechanism includes a sheet confinement chamber, and first, second and third roller assemblies. The mechanism also includes a sheet entrance nip formed by the first and second roller assemblies for feeding a sheet into the confinement chamber, and a sheet exit nip formed by the second and third roller assemblies for feeding a sheet out of the confinement chamber. The inverter mechanism further includes a simultaneous sheet handling approach angle of about 48° formed by the first and third roller assemblies about the second roller assembly such that a sheet being fed into the confined chamber contacts a sheet being fed at the same time out of the chamber at such an approach angle.

BRIEF DESCRIPTION OF THE DRAWINGS

In the detailed description of the invention below, reference is made to the drawings, in which.

DETAILED DESCRIPTION OF THE PREFERRED EMBODIMENT

Because electrostatographic reproduction apparatus are well known, the present description will be directed in particular to elements forming part of or cooperating more directly with the present invention. Apparatus not specifically shown or described herein are selectable from those known in the prior art.

Figure 1:
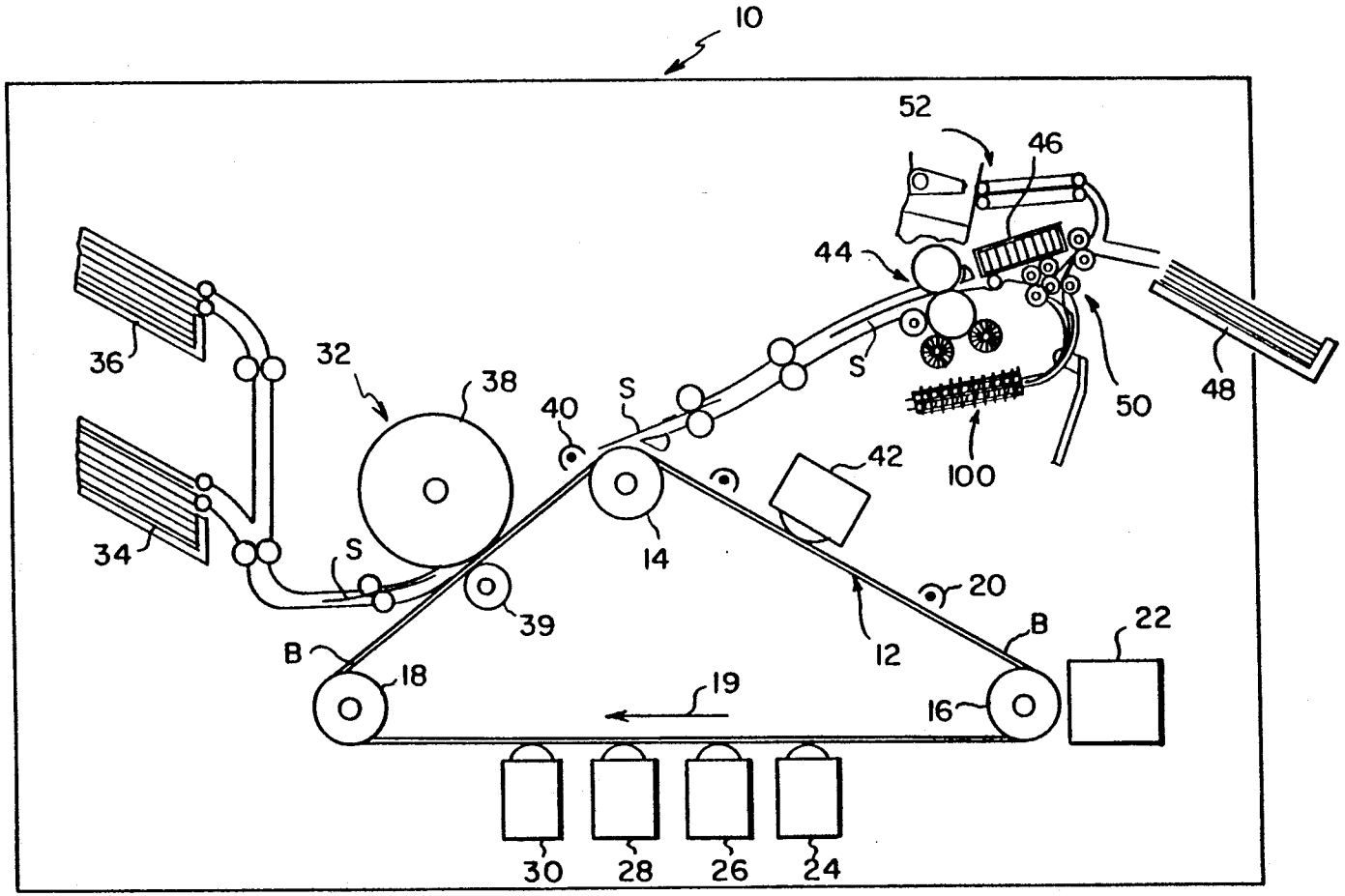
FIG. 1 is a schematic diagram of a sheet-handling electrostatographic printer incorporating the present invention.

Referring now to FIG. 1, a sheet-handling piece of equipment, such as an electrostatographic apparatus such as a copier or printer, is shown generally as 10. The equipment 10, as shown, includes an image-bearing member 12 which can be, for example, an endless photoconductive web trained about a plurality of rollers 14, 16 and 18. One of such rollers can be a drive roller for moving the member 12 in the direction of the arrow 19. As is well known, the member 12 can also be a rotatable rigid drum.

The copier or printer 10 also includes a charging station 20 for placing a uniform electrostatic charge on an image-bearing surface B of the member 12, and an imagewise exposure station 22, shown as an electronic printhead, which may employ LED's or a laser, etc. for creating an electrostatic image pattern in the laid down charges. Of course, such an image pattern may also be formed using optical means at an appropriate optical exposure station, or by an electrographic writer. The created image pattern is next developed with toner particles of one or more colors at one or more of the development stations therein, shown as 24, 26, 28, 30, and each containing toner particles of a different color. The developed image on the surface B is subsequently transferred, at a transfer station 32 onto a first side of a suitable receiver sheet S, such as plain paper or a transparency fed in registration from a supply tray 34 or 36 thereof. As shown, the transfer station 32 may include a charged transfer drum 38, and a back-up roller 39. The transer drum 38 supports the receiver sheet S thereon for accepting one or a plurality of images.

Following transfer of one or more of the toner images to the first side of the sheet S, the sheet S is then separated from the surface B, for example, with the help of a detack corona 40. The surface B is subsequently cleaned at a cleaning station 42 in preparation for reuse similarly in forming and transferring another toner image.

Meanwhile, the sheet S, after such separation, is transported for example by rollers and guides as shown, to and through a fusing station 44. As is well known, the toner image on the first side of the receiver sheet S is heated at the fusing station 44 and fused onto such first side. The sheet S with the fused toner image on such first side thereof can thereafter be transported past a cooling device 46, and directly to a finished copy sheet output tray shown as 48.

Alternatively, the sheet S with the fused toner image on such first side thereof, may be inverted by means of the sheet inverter mechanism of the present invention, shown generally as 50, for reuse within the copier or printer for example for duplex imaging. As is well known, for such duplex imaging, two sequential "complete" toner images, for transfer to the first and second sides of the sheet S, are formed on the surface B. Each of these "complete" toner images may be comprised of plural color toner images that taken together form a "complete" toner image of the original. The first of the two "complete" images is first transferred, as above, to the first side of sheet S for fusing thereonto as described above. By means of an inverter mechanism such as 50, the sheet S is then inverted and returned, for example, by means shown partially as 52, to the transfer station 32, to receive the second of the two toner images onto the second side of such sheet S. Inversion of the sheet S therefore requires a reversion of the lead and trail edge orientation thereof, and hence the front-and-back face orientation of the sheet S as viewed relative to the image-bearing surface B. The second side of the sheet S after receiving the second "complete" toner image thereon is thereafter similarly separated from the surface B for fusing at the fusing station 44. The sheet S can then be transported to the output tray 48.

Referring now to FIGS. 2 to 5B, the sheet turnover or inverter mechanism 50 of the present invention is illustrated in detail. The inverter mechanism 50, in order to operate properly within the high speed copier or printer 10, is capable of inverting sheets at high speeds, for example, of 100 or more sheets per minute. Particularly, the mechanism 50 is capable at such speeds of efficiently and reliably inverting sheets of a particular size which may vary sheet-to-sheet in dimensions, weight and beam strength without misfeeds or jams. Additionally, the mechanism 50 is capable of tolerating significant sheet trail edge curls, some sheet skewing, and less than precise sheet control therewithin. More importantly, the mechanism 50 is capable of simultaneously handling within its confinement chamber two consecutive sheets being inverted in the efficient and reliable manner as described above.

Figure 2:
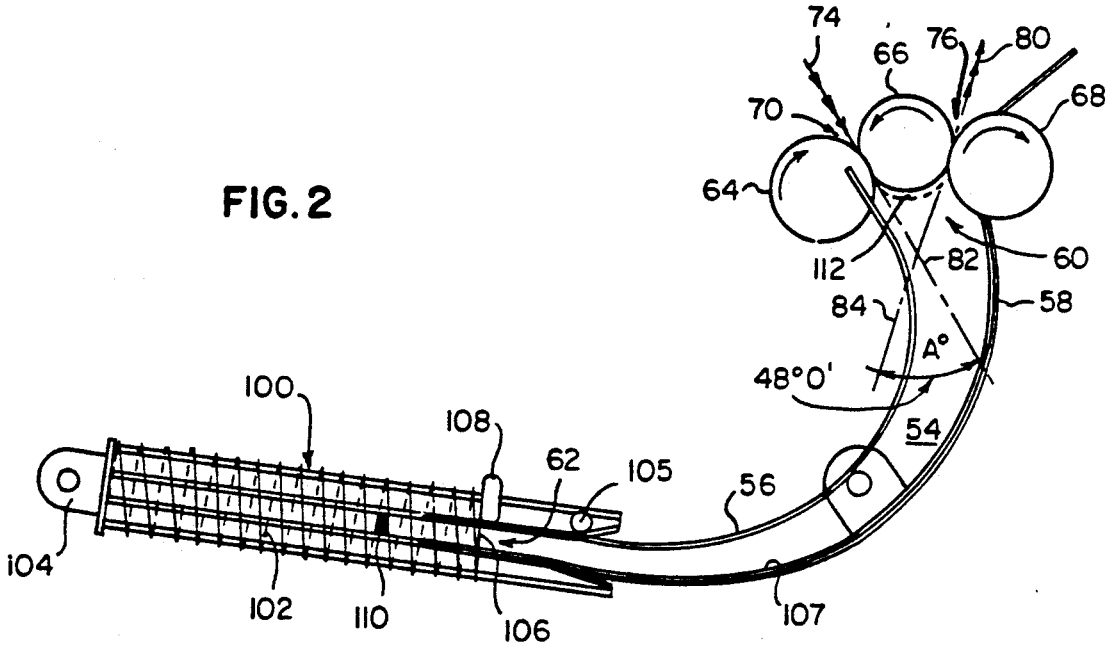
FIG. 2 is an enlarged side view, partly in section, of the sheet inverter mechanism of the present invention.

Referring now to FIGS. 2–5B, the sheet inverter mechanism 50 and particular features thereof are illustrated in detail. As shown in FIG. 2, the mechanism 50 includes a sheet turnover or confinement chamber 54 which is defined as a space between a pair of first and second sheet curved guide plates or walls 56, 58. The chamber 54 has a front end 60 and back end 62 relative to the movement of a sheet thereinto. The mechanism 50 further includes, first, second and third roller assemblies 64, 66, and 68, respectively, mounted as shown across the mouth of the front end 60. The first and second roller assemblies 64, 66, respectively, form therebetween a sheet entrance nip 70 for an entering sheet shown as 72 (FIG. 4B), that is being fed into the chamber 54 along a first sheet path 74. The second and third roller assemblies 66, 68, respectively form therebetween a sheet exit nip 76 for an exiting sheet shown as 78 (FIG. 4B), that is being fed out of the chamber 54 along a second sheet path 80.

Figure 4A:
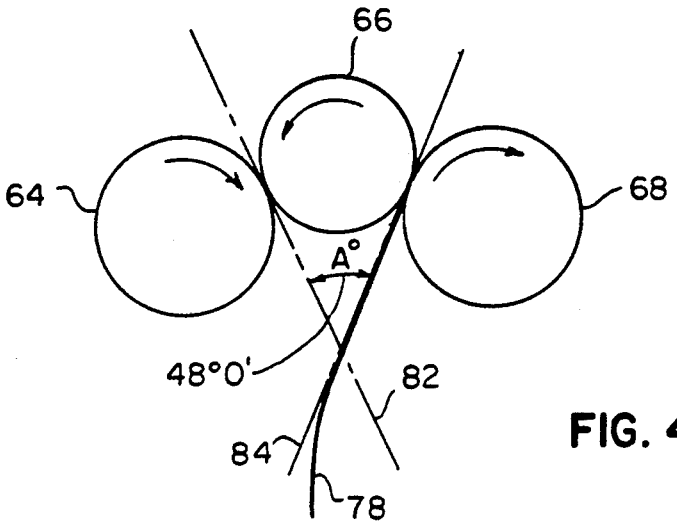
FIGS. 4A–4B are schematic side views of the roller assemblies of the present invention, showing the particular approach angle, and the simultaneous relationship of an exiting sheet and an entering sheet.

In the present invention, in order to efficiently and reliably handle both an entering sheet 72 and an exiting sheet 78 at the same time, that is, simultaneously, through the chamber 54, the first and third roller assemblies 64, 68 respectively are mounted relative to the second roller assembly 66 such that an entering sheet 72 will contact an exiting sheet 78 at an approach angle A° of about 48°. As shown in FIGS. 2 and 4A, this simultaneous sheet handling approach angle A° can be defined theoretically by a common entrance nip tangent 82 drawn through the entrance nip between the roller assemblies 64, 66, and by a common exit nip tangent 84 drawn through the exit nip between the roller assemblies 66, 68. In the high-speed simultaneous sheet handling mechanism 50 of the present invention, the approach angle A° is critical to the efficient and reliable operation of the mechanism, as will be explained below.

Figure 3:
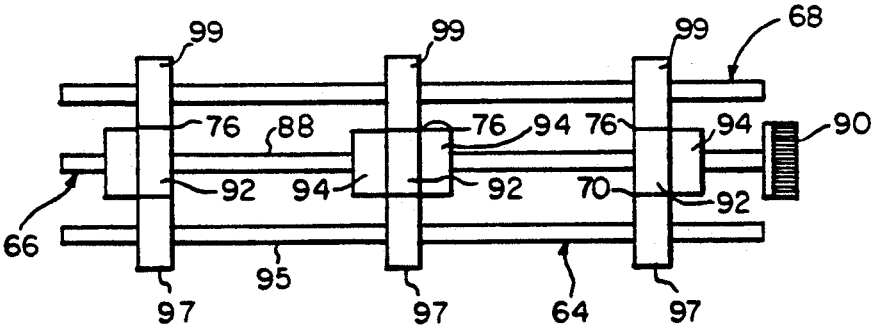
FIG. 3 is a top view of the roller assemblies of the present invention.

Referring now to FIGS. 2 and 3, the roller assemblies 64, 66 and 68 are shown with the centrally located roller assembly 66 being the drive assembly, and the outer assemblies 64, 68 being idler assemblies. The drive assembly 66 includes a drive shaft 88 that is made, for example, of stainless steel, and is driven by suitable means (not shown) that is coupled to a drive pulley 90 supported for rotation with the shaft 88. The assembly 66 further includes a plurality of hard rollers each shown as 92, and a plurality of soft reticulated (that is, expanded spongy rollers having interlaced fibers which run in every direction) foam rollers each shown as 94 are slightly larger in diameter than the hard rollers 92. The hard and soft rollers 92, 94 are mounted fixedly onto the shaft 88 for rotation therewith. The idler assemblies 64, 68 include idler shafts 95, 96 and corresponding hard rollers shown as 97 and 99, respectively, for mating with the hard rollers 92 of the drive assembly 66. As shown, the corresponding hard rollers 97, 92 form the entrance nip 70, and those 92, 99 form the exit nip 76. The roller assemblies 64, 66 and 68 are drivable in the direction of the rotation of the arrows shown.

Figure 5A:
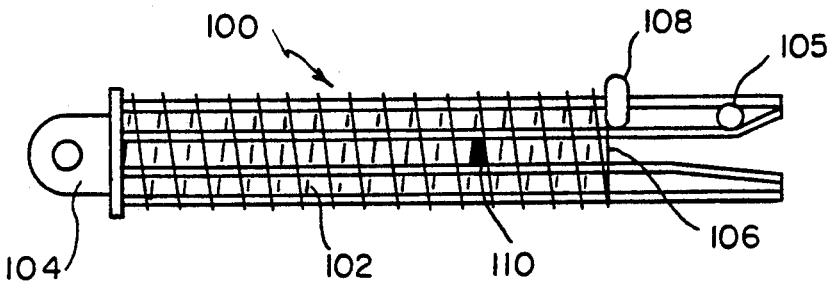
FIG. 5A is an illustration of the removable sheet stop and recoil assembly of the present invention.

As further shown in FIGS. 2 and 5A, the sheet turnover or inverter mechanism 50 of the present invention includes a separate and independent sheet recoil assembly 100 at the back end 62 of the chamber 54. The assembly 100 includes means, such as a bounce spring 102, for uniformly stopping the lead edge of a sheet that has been fed into the confinement chamber 54, and for then recoiling such sheet back towards the front end 60. The spring 102, as shown, is mounted and retained on a frame 104. The frame 104 includes means, for example, a pin 105 for attaching it in an overlapping relationship to the chamber guide plates 56, 58. The spring 102, as shown, is a compression spring having a free and movable end 106 adjustably retained against a member such as a pin 108, and a fixed and opposite end attached to the frame 104.

The spring 102 preferably is made from music or piano wire. The guage and actual length of wire used, and the number coils thereof employed for stopping and recoiling sheets within the chamber 54, of course, depend on the particular range of sheet weights and sizes to be handled. Heavier sheets, for example, will compress or deflect the free end of the spring more than will lighter sheets. As shown, an adjustable intermediate spring deflection stop 110 may be added to the assembly 100 in order to reduce the number of effective coils of the spring 102 which act against a sheet that is bounced against the free end 106. Accordingly, a spring 102 made suitably for handling light sheets can be adjusted with the stop 110 so as to be able to handle much heavier type sheets.

Figure 5B:
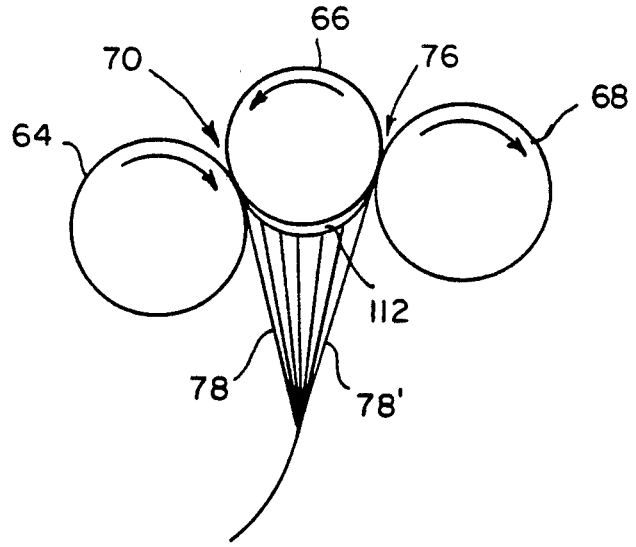
FIG. 5B is an illustration of the trail-edge separation gap and its function in the present invention.

In accordance with the present invention, the sheet recoil assembly 100 is attached to the guide plates 56, 58 such that the free end 106 of the spring 102 is positioned spaced a particular distance from the soft and larger foam rollers 94 of the roller assembly 66. Specifically, at such a particular distance, the spring 102 is positioned (at the back end 62 of the chamber 54) such that when the lead edge of a sheet being fed thereinto contacts and fully deflects the spring 102 to where forward sheet motion is stopped, the trail edge of such sheet will be free of, that is, it will be spaced from the periphery of the soft rollers 94 by a small trail-edge separation gap shown as 112 (FIGS. 2 and 5B).

In operation, when an entering sheet, for example, 78 is being fed as the first sheet into the chamber 54 for inversion, the lead edge thereof will pass through the entrance nip 70 into the front end 60 of the chamber 54. As the sheet 78 moves further into the chamber towards the back end 62 thereof, the lead edge of the sheet will substantially follow the entrance-nip tangent 82 (FIGS. 2 and 4A). As such, the lead edge will contact the outer guide plate 58 as shown, and will be guided thereby until such lead edge hits the free end 106 of the bounce spring 102, and thereby deflects the free end 106 until forward motion of the edge is stopped. The guide plate 58, as shown, also includes a service door 107 which, according to the present invention, is made from a carbon-filled polycarbonate for static dissipation purposes.

Conventionally, when the sheet 78 is fed as such into deflecting contact with a recoil means such as the spring 102 of the assembly 100, the trail edge of the sheet 78 preferably should be, or should remain in contact with the soft form rollers 94 in order for the rollers 94 to "walk" such trail edge from the entrance nip 70 over to the exit nip 76. Ordinarily, such "walking" requires precision in the interface of the roller 94 and such trail edge, precision which can only be achieved at a high cost given expected variability, for example, in sheet weight, sheet dimension and operating conditions such as the speed of the entrance nip rollers. Ordinarily, too, sheet skew problems, and any lack of precise control over the trail edge in such conventionally operating J inverters will result in "walk"-over failures.

According to the present invention, however, the spring 102 is positioned such that when the sheet 78 is fully stopped thereby, the trail edge thereof will be spaced by the small edge separation gap 112 from the soft rollers 94. The "J-shape" geometry of the chamber 54 of the mechanism 50 is such that the trail edge of the sheet 78 so spaced, will be caused to move away from the inner guide plate 56 towards the outer guide plate 58. At the same time, the recoil force imparted into the sheet's lead edge by the spring 102 will cause the trail edge to move backwards towards the foam rollers 94 from which such edge was spaced the gap 112. As a result, the trail edge thereof recontacts the rollers 94 (while still moving outwardly towards the outside guide plate 58) at a point close to the exit nip 76. The rollers 94 thereafter easily and quickly move such trail edge into the exit nip 76 of the roller assemblies 66, 68.

In this manner, the soft rollers 94 are not required to "walk" the trail edge all the way from the entrance nip 70 over to the exit nip 76. Accordingly, conventional precision, as above, is therefore not required, nor is precise trail edge control. The trail edge, for example, will follow a contact-spaced-recontact path as shown in FIG. 5B where the incoming sheet 78 is illustrated as moving, spaced the small gap 112, and then exiting the chamber 54 shown as 78'. At high throughput speeds of 100 sheets or more, the gap 112 should preferably be less than ⅛ or 0.125 of an inch.

Figure 4B:
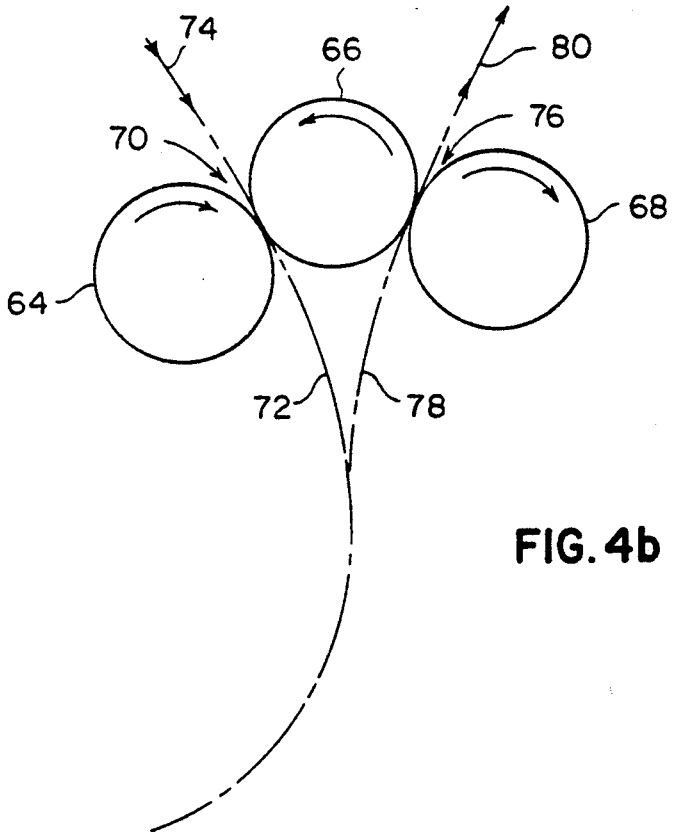

Also, in accordance with the present invention, as shown in FIGS. 4B and 5B, as soon as the trail edge of the sheet 78 as above recontacts the rollers 94 on its way into the exit nip 76, the ledge edge of a second sheet 72 can already be on its way into the chamber 54. Again, as above, the lead edge of this second sheet will be traveling into the chamber 54 along the entrance nip tangent 82 towards the outside guide plate 58. As such, the second sheet 72 will contact (not the outside guide plate 58) but the first sheet 78 which is about to, or is being fed out of the chamber 54 through exit nip 76. The entering sheet 72 will therefore rub against, and be guided by, the outgoing or exiting sheet 78 towards the back end 62 of the chamber 54. About 5 inches or more of each of the 8.5 inch dimension of each sheet 72, 78 may rub together, as such, within the chamber 54.

According to the present invention, the angle A° at which the entering sheet 72 approaches and contacts the exiting sheet 78 has been found to be extremely important. Such an approach angle, which is within the narrow range of 46.5°–49.5°, has been found to be very effective and reliable in the simultaneous handling of the sheets 72 and 78 as above. A preferred approach angle A° is about 48°. An angle A° narrower than the above range will increase the distance the trail edge, for example of the sheet 78, has to travel between release from, and recontact with, the soft rollers 94. The trail edge, as such, will require relatively more time to go from the entrance nip 70 to the exit nip 76 thereby significantly risking interference with the lead edge of the second entering sheet. Such a lead edge may actually catch part or all of, such a slow trail edge, possibly folding it backwards towards the back end 62 of the chamber 54 and away from the exit nip 76. On the other hand, a too wide an approach angle A° may cause the exiting first sheet 78 to catch the lead edge of the second entering sheet 72 possibly folding it backwards towards the roller assemblies 64, 66, 68 and into the exit nip 76. In either case, the undesirable result is a jam, and failure of the inverter mechanism 50.

At the desirable approach angle A° of about 48°, the distance of travel for the trail edge from the entrance nip 70 to the exit nip 76 has been found to be very effective and reliable. The tendency of the lead edge of the second sheet 72 at the angle of about 48° is, in part, to force the first sheet 78 and its trail edge, into the exit nip 76, as well as to slide against such first sheet 78 on its way to the bounce spring 102. The timing is such that by the time the second sheet recontacts the rollers 94, after having been released thereby into a spaced and recoiled condition, the first sheet 78 will effectively be out of the chamber 54. It has been found, for example, that the sheets 78, 72 respectively, can be handled effectively and reliably as described above traveling spaced only a distance of about one inch between the trail edge of one and the lead edge of the other at sheet speeds of 100 or more sheets per minute through the nip rollers.

As can be seen, the inverter mechanism can be used with high-speed sheet handling equipment. At the approach angle of about 48°, it can reliably and effectively handle an entering sheet and an exiting sheet simultaneously through its sheet confinement chamber. Additionally, given its built-in "trail edge separation gap" feature and mode of operation, it can efficiently handle sheets despite sheet-to-sheet variations in weight and dimensions, and without need of costly precision in parts and assembly.

The invention has been described in detail with particular reference to a presently preferred embodiment, but it will be understood that variations and modifications can be effected within the spirit and scope of the invention.

What is claimed is:

1. A high-speed sheet inverter mechanism for use in sheet handling equipment, the sheet inverter including:

(a) a sheet confinement chamber;

(b) first and second roller assemblies;

(c) a sheet entrance nip formed by said first and second roller assemblies for feeding a sheet into said chamber;

(d) a third roller assembly;

(e) a sheet exit nip formed by said second roller assembly and said third roller assembly for feeding a sheet out of said chamber; and (f) a simultaneous sheet handling approach angle of about 48° formed by said first and third roller assemblies about said second roller assembly such that a sheet being fed into said chamber contacts a sheet being fed at the same time out of said chamber at said approach angle.

2. The sheet inverter mechanism of claim 1 further including a trail edge separation between said second roller assembly and a trail edge of a sheet being fed into said chamber, and sheet lead edge stopping means positioned within said chamber and spaced from said second roller assembly such that when the lead edge of the sheet being fed into said chamber is fully stopped thereby, the trail edge of such sheet will be spaced from the periphery of said second roller assembly by said trail edge separation gap.

3. The sheet inverter mechanism of claim 1 or 2 wherein said sheet-handling approach angle is within the range of 46.5°–49.5°.

4. The sheet inverter mechanism of claim 2 wherein said trail edge separation gap is less than 0.125 of an inch.

5. The sheet inverter mechanism of claim 2 wherein said trail edge separation gap is less than 0.125 of an inch.

6. A high-speed sheet inverter mechanism for use in sheet-handling equipment, the inverter mechanism including:

(a) a sheet confinement chamber defined by first and second sheet guiding walls, said confinement chamber having a front end and a back end thereto;

(b) first roller assembly mounted across said front end of said chamber;

(c) a second roller assembly also mounted across said first end of said chamber to a first side of said first roller assembly, said first and second roller assemblies forming a sheet entrance nip for feeding sheets into said chamber, and said first and second roller assemblies having a common entrance-nip tangent through said entrance nip; and (d) a third roller assembly mounted across said first end of said chamber to a second side of said first roller assembly, said first and third roller assemblies forming a sheet exit nip for feeding sheets out of said chamber, said first and third roller assemblies having a common exit-nip tangent through said exit nip, and said exit-nip tangent forming an angle of about 48° with said entrance-nip tangent.

7. The invention mechanism of claim 6 further including recoil means at said back end of said chamber for stopping and reversing the direction of motion of a sheet fed through said entrance nip into said chamber.

8. A sheet turnover mechanism for use in a high-speed electrostatographic apparatus to simultaneously handle an incoming sheet, and an exiting sheet, at a high rate of speed, the turnover mechanism including:

(a) a sheet receiving and confinement chamber defined by a pair of guide plates;

(b) a sheet entrance nip, forming part of a first sheet path, for an entering sheet being fed into said chamber, said entrance nip being formed by a first roller assembly and a second roller assembly;

(c) a sheet exit nip, forming part of a second sheet path, for an exiting sheet being fed out of said chamber, said exit nip being formed by said second roller assembly and a third roller assembly, said first and third roller assemblies being mounted relative to said second roller assembly such that a sheet entering through said entrance nip into said chamber contacts a sheet already in said chamber and being fed out thereof through said exit nip at an approach angle of about 48°; and (d) sheet stopping and recoiling means located within said chamber at a predetermined point from said second roller assembly for stopping the motion of an incoming sheet, and for then imparting unto such sheet a backward recoil force towards said exit nip.

9. The mechanism of claim 8 wherein one of said guide plates includes an access door into said chamber, and said door includes means for dissipating static charges within said chamber.

10. The mechanism of claim 8 wherein a second roller assembly comprises a drive shaft including a drive pulley, three equally spaced apart nip forming hard rollers, and four reticulated foam rollers for urging the trail edge of an incoming sheet into said exit nip.

11. The mechanism of claim 8 wherein said sheet stopping and recoiling means comprises a piano wire compression spring for bouncing a sheet fed thereagainst, a frame for retaining said compression spring, and an intermediate spring deflection stop member for varying the number of active coils of said spring acting against a sheet being bounced.

12. A method for inverting sheets, the method comprising the steps of:

(a) advancing the lead edge of a first sheet through an entrance nip in a front portion and into a back portion of a curved sheet inverter chamber;

(b) bouncing the lead edge against resilient means at said back portion so as to recoil said first sheet back into an exit nip in said front portion of said chamber; and (c) advancing the lead edge of a second sheet through said entrance nip in said front portion so that said lead edge of said second sheet engages said first sheet in said chamber such that the angle of approach of the second sheet relative to the line of exit of the first sheet is approximately 48°.

13. A sheet inverter mechanism having a throughput speed greater than 99 sheets per minute, the inverter mechanism including:

(a) a sheet confinement chamber;

(b) a middle roller forming an entrance nip with a first roller and an exit nip with a second roller;

(c) feed means including said middle roller for feeding a first sheet through said entrance nip into said confinement chamber until a trailing edge of such first sheet is past and spaced from said middle roller;

(d) moving means for moving such spaced trailing edge of such first sheet from the entrance nip over to the exit nip, said moving means including a curvature of said confinement chamber for imparting beam strength to such first sheet, and a second sheet fed by said feeding means into contact with such first sheet within said confinement chamber for kicking such first sheet from the entrance nip wherein the second sheet contacts the first sheet within the chamber at an angle of about 48 degrees towards the exit nip; and (e) discharging means including said middle roller for removing such first sheet, such trailing edge thereof first, from said confinement chamber through the exit nip.

* * * * *